US009175898B2

(12) United States Patent
Chae et al.

(10) Patent No.: US 9,175,898 B2
(45) Date of Patent: Nov. 3, 2015

(54) REFRIGERATOR HAVING COLD AIR GENERATING COMPARTMENT AND MACHINE ROOM POSITIONED AT UPPER PORTION OF CABINET

(75) Inventors: Su Nam Chae, Seoul (KR); Kyeong Yun Kim, Seoul (KR); Jang Seok Lee, Seoul (KR); Min Kyu Oh, Seoul (KR); Youn Seok Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 1273 days.

(21) Appl. No.: 12/633,884

(22) Filed: Dec. 9, 2009

(65) Prior Publication Data

US 2010/0192617 A1 Aug. 5, 2010

(30) Foreign Application Priority Data

Jan. 30, 2009 (KR) ..... 10-2009-0007298

(51) Int. Cl.

| | |
|---|---|
| ***F25D 17/00*** | (2006.01) |
| ***F25D 17/06*** | (2006.01) |
| ***F25D 17/08*** | (2006.01) |
| ***F25D 19/00*** | (2006.01) |
| *F25D 17/04* | (2006.01) |
| *F25D 21/14* | (2006.01) |

(52) U.S. Cl.

CPC ..... *F25D 17/065* (2013.01); *F25D 17/08* (2013.01); *F25D 19/00* (2013.01); *F25D 17/045* (2013.01); *F25D 21/14* (2013.01); *F25D 2317/0651* (2013.01); *F25D 2317/0654* (2013.01); *F25D 2317/0665* (2013.01); *F25D 2317/0682* (2013.01); *F25D 2400/06* (2013.01)

(58) Field of Classification Search

CPC ..... F25D 17/08; F25D 17/065; F25D 17/045; F25D 19/00; F25D 21/14; F25D 2317/0651; F25D 2317/0654; F25D 2317/0665; F25D 2317/0682; F25D 2400/06

USPC ..... 62/177, 178, 186, 187, 216, 217, 419

See application file for complete search history.

(56) References Cited

U.S. PATENT DOCUMENTS

| | | | | |
|---|---|---|---|---|
| 2,812,642 | A | 11/1957 | Jacobs | |
| 3,590,594 | A * | 7/1971 | Arend | 62/187 |
| 3,712,078 | A | 1/1973 | Maynard et al. | |
| 4,505,131 | A * | 3/1985 | Boxall | 62/417 |
| 4,843,833 | A * | 7/1989 | Polkinghorne | 62/187 |

(Continued)

FOREIGN PATENT DOCUMENTS

| | | |
|---|---|---|
| CN | 1479065 A | 3/2004 |
| CN | 101275802 A | 10/2008 |

(Continued)

OTHER PUBLICATIONS

PCT International Search Report and Written Opinion dated Jun. 15, 2011 for Application No. PCT/KR2009/006856), 11 pages.

(Continued)

*Primary Examiner* — Ljiljana Ciric

(74) *Attorney, Agent, or Firm* — Fish & Richardson P.C.

(57) ABSTRACT

A refrigerator includes a cabinet comprising a storage compartment An evaporator is positioned at an upper portion of the cabinet and generates cold air supplied to the storage compartment. A unit (e.g., closable damper) controls supply of cold air generated by the evaporator to the storage compartment.

13 Claims, 21 Drawing Sheets

(56) References Cited

U.S. PATENT DOCUMENTS

| | | | | |
|---|---|---|---|---|
| 4,876,860 | A | 10/1989 | Negishi | |
| 5,433,086 | A * | 7/1995 | Cho et al. | 62/455 |
| 5,816,060 | A * | 10/1998 | Brownell et al. | 62/186 |
| 5,884,491 | A * | 3/1999 | Kim et al. | 62/186 |
| 5,899,083 | A * | 5/1999 | Peterson et al. | 62/186 |
| 5,966,951 | A * | 10/1999 | Hallin et al. | 62/186 |
| 6,055,820 | A * | 5/2000 | Jeong et al. | 62/186 |
| 6,735,976 | B2 | 5/2004 | Lee | |
| 6,772,601 | B1 | 8/2004 | Davis | |
| 6,802,186 | B2 * | 10/2004 | Holmes et al. | 62/187 |
| 6,997,008 | B2 | 2/2006 | Lee et al. | |
| 7,003,973 | B2 | 2/2006 | Lee et al. | |
| 7,040,118 | B2 | 5/2006 | Jung | |
| 7,114,345 | B2 | 10/2006 | Kim et al. | |
| 7,185,509 | B2 | 3/2007 | Lee et al. | |
| 7,188,490 | B2 | 3/2007 | Jeong et al. | |
| 7,322,209 | B2 | 1/2008 | Hwang et al. | |
| 7,665,320 | B2 * | 2/2010 | Scrivener et al. | 62/187 |
| 7,765,819 | B2 * | 8/2010 | Anell et al. | 62/186 |
| 7,900,465 | B2 * | 3/2011 | Wetekamp et al. | 62/187 |
| 8,037,701 | B2 * | 10/2011 | Anell et al. | 62/187 |
| 8,042,355 | B2 * | 10/2011 | Cur et al. | 62/186 |
| 8,061,153 | B2 * | 11/2011 | Cur et al. | 62/186 |
| 8,161,760 | B2 * | 4/2012 | Cur et al. | 62/186 |
| 8,245,524 | B2 * | 8/2012 | Kuehl | 62/185 |
| 8,336,321 | B2 * | 12/2012 | Cur et al. | 62/175 |
| 8,336,322 | B2 * | 12/2012 | Cur et al. | 62/185 |
| 8,341,974 | B2 * | 1/2013 | Oh et al. | 62/187 |
| 8,683,820 | B2 * | 4/2014 | Lee et al. | 62/419 |
| 8,746,005 | B2 * | 6/2014 | Yoon | 62/419 |
| 8,789,387 | B2 * | 7/2014 | Kim et al. | 62/419 |
| 8,789,388 | B2 * | 7/2014 | Lee et al. | 62/344 |
| 8,794,019 | B2 * | 8/2014 | Kuehl et al. | 62/187 |
| 8,806,885 | B2 * | 8/2014 | Bae et al. | 62/419 |
| 8,833,093 | B2 * | 9/2014 | Tarr | 62/187 |
| 8,857,199 | B2 * | 10/2014 | Shinya et al. | 62/186 |
| 8,863,537 | B2 * | 10/2014 | Junge | 62/179 |
| 8,943,852 | B2 * | 2/2015 | Lee et al. | 62/420 |
| 8,978,406 | B2 * | 3/2015 | Candeo | 62/408 |
| 8,978,410 | B2 * | 3/2015 | Oh et al. | 62/513 |
| 8,984,908 | B2 * | 3/2015 | Bae et al. | 62/419 |
| 2003/0108647 | A1 | 6/2003 | Grandi | |
| 2004/0040335 | A1 | 3/2004 | Lee | |
| 2005/0218766 | A1 | 10/2005 | Hwang | |
| 2014/0060106 | A1 * | 3/2014 | Van Meter et al. | 62/340 |
| 2014/0305156 | A1 * | 10/2014 | Lee et al. | 62/340 |
| 2014/0338386 | A1 * | 11/2014 | Martin et al. | 62/344 |

FOREIGN PATENT DOCUMENTS

| | | | |
|---|---|---|---|
| EP | 1 394 485 | A2 | 3/2004 |
| JP | 7-19704 | | 1/1995 |
| KR | 10-1998-0083022 | A | 12/1998 |
| KR | 10-2005-0102327 | A | 10/2005 |
| KR | 10-0850957 | B1 | 8/2008 |

OTHER PUBLICATIONS

Chinese Office Action dated Dec. 7, 2012 for Appln No. 200980157550.1, with English Translation, 18 pages.

European Search Report dated Apr. 22, 2014 for Application No. 09839332.5, 7 pages.

Korean Notice of Allowance dated Aug. 3, 2015 for Korean Application No. 10-2009-0007298, with English Translation, 3 pages.

* cited by examiner

FIG. 12

1200

| 1210 Current Damper Configuration | | 1220 Temperature | | 1230 Door Position | | 1240 Door Open Duration | | 1250 Number of Door Openings | | 1260 Time In Single | 1270 Set Damper Configuration | |
|---|---|---|---|---|---|---|---|---|---|---|---|---|
| Freezer | Fridge | Freezer | Fridge | Freezer | Fridge | Freezer | Fridge | Freezer | Fridge | Config. | Freezer | Fridge |
| Open | Open | In Range | In Range | Closed | Closed | N/A | N/A | N/A | N/A | N/A | Open | Open |
| Open | Open | < Range | In Range | Closed | Closed | N/A | N/A | N/A | N/A | N/A | Closed | Open |
| Open | Open | In Range | < Range | Closed | Closed | N/A | N/A | N/A | N/A | N/A | Open | Closed |
| Open | Open | > Range | In Range | Closed | Closed | N/A | N/A | N/A | N/A | N/A | Open | Closed |
| Open | Open | In Range | > Range | Closed | Closed | N/A | N/A | N/A | N/A | N/A | Closed | Open |
| Open | Open | > Range | > Range | Closed | Closed | N/A | N/A | N/A | N/A | N/A | Open | Open |
| Open | Open | < Range | < Range | Closed | Closed | N/A | N/A | N/A | N/A | N/A | Closed | Closed |
| Open | Open | > Range | In Range | Open | Closed | < Limit | N/A | < Limit | N/A | < Limit | Open | Closed |
| Open | Closed | > Range | In Range | Open | Closed | > Limit | N/A | < Limit | N/A | < Limit | Closed | Open |
| Open | Closed | > Range | In Range | Open | Closed | < Limit | N/A | > Limit | N/A | < Limit | Closed | Open |
| Open | Closed | > Range | In Range | Closed | Closed | N/A | N/A | N/A | N/A | > Limit | Open | Open |
| Closed | Open | In Range | > Range | Closed | Open | N/A | > Limit | N/A | > Limit | < Limit | Open | Closed |
| Closed | Open | < Range | > Range | Closed | Open | N/A | > Limit | N/A | > Limit | < Limit | Closed | Closed |
| Open | Open | In Range | In Range | Closed | Open | N/A | > Limit | N/A | < Limit | N/A | Open | Closed |
| Open | Open | > Range | > Range | Open | Open | < Limit | > Limit | < Limit | < Limit | N/A | Open | Closed |

REFRIGERATOR HAVING COLD AIR GENERATING COMPARTMENT AND MACHINE ROOM POSITIONED AT UPPER PORTION OF CABINET

CROSS REFERENCE TO RELATED APPLICATION

This application claims the benefit of Korean Patent Application No. 10-2009-0007298, filed on, Jan. 30, 2009, which is hereby incorporated by reference as if fully set forth herein.

FIELD

The present disclosure relates to refrigerator technology.

BACKGROUND

Refrigerators are home appliances that are able to freeze or preserve fresh foods, such as meats, fruits, beverages, and the like, in predetermined storage compartments, using a four-step-cycle of compressing, condensing, expanding and evaporating refrigerant. Such a refrigerator may have a cabinet including a storage compartment, a door coupled to the cabinet to open and close the storage compartment, a cold air generating compartment accommodating an evaporator to generate cold air, and a machine compartment accommodating components, such as a compressor and a condenser and the like.

According to some configurations of a refrigerator, the cold air generating compartment is provided in a rear of the storage compartment. For example, a refrigerating compartment or freezing compartment and the cold air generating compartment are partitioned by a partition wall. The machine compartment is provided in a rear portion under the storage compartment.

SUMMARY OF THE DISCLOSURE

In one aspect, a refrigerator includes a cabinet, a storage compartment defined by the cabinet and having a top surface that defines a top of the storage compartment when the cabinet is oriented in an ordinary operating orientation, and an evaporator positioned at an upper portion of the cabinet and configured to generate cold air supplied to the storage compartment. The upper portion of the cabinet is located at a vertical position that is higher than the top surface of the storage compartment when the cabinet is oriented in the ordinary operating orientation. The refrigerator also includes a unit configured to control supply of cold air generated by the evaporator to the storage compartment.

Implementations may include one or more of the following features. For example, the refrigerator may include a cold air generating compartment that is positioned at the upper portion of the cabinet, that is in communication with the storage compartment, and that is configured to accommodate the evaporator. In this example, the refrigerator may include a cold air outlet positioned between the cold air generating compartment and the storage compartment and configured to guide cold air generated by the evaporator toward the storage compartment. The refrigerator also may include a cold air fan configured to promote movement of cold air generated by the evaporator through the cold air outlet and into the storage compartment. The unit may be configured to control supply of cold air through the cold air outlet.

In addition, the storage compartment may be a refrigerating compartment and the refrigerator may include a freezing compartment defined by the cabinet in parallel with the refrigerating compartment. The cold air generating compartment may be in communication with the freezing compartment and the refrigerating compartment.

In some examples, the cold air outlet may be a first cold air outlet in communication with the refrigerating compartment and the unit may be a first unit configured to control supply of cold air through the first cold air outlet. In these examples, the refrigerator may include a second cold air outlet positioned between the cold air generating compartment and the freezing compartment and configured to guide cold air generated by the evaporator toward the freezing compartment and a second unit configured to control supply of cold air through the second cold air outlet.

In some implementations, the refrigerator may include a first return duct that connects the refrigerating compartment with the cold air generating compartment and that is configured to guide air from inside of the refrigerating compartment toward the cold air generating compartment. The refrigerator also may include a second return duct that connects the freezing compartment with the cold air generating compartment and that is configured to guide air from inside of the freezing compartment toward the cold air generating compartment. In these implementations, the refrigerator may include a first return unit configured to control air flow through the first return duct and a second return unit configured to control air flow through the second return duct.

Further, the refrigerator may include a return duct that connects each of the refrigerating compartment and the freezing compartment with the cold air generating compartment. The return duct may be configured to guide air from inside each of the refrigerating compartment and the freezing compartment toward the cold air generating compartment and may be positioned in a barrier between the refrigerating compartment and the freezing compartment.

The refrigerator may include a control unit configured to perform operations that include accessing a first temperature measurement for the refrigerating compartment and accessing a second temperature measurement for the freezing compartment. The operations also may include comparing the first temperature measurement to a first temperature threshold, comparing the second temperature measurement to a second temperature threshold, and determining whether the first temperature measurement is above the first temperature threshold and whether the second temperature measurement is above the second temperature threshold based on the comparisons. The operations further may include controlling the first unit and the second unit to supply cold air generated by the evaporator to the refrigerating compartment only, the freezing compartment only, or both the refrigerating compartment and the freezing compartment based on the determination of whether the first temperature measurement is above the first temperature threshold and whether the second temperature measurement is above the second temperature threshold.

The refrigerator may include a machine room positioned at the upper portion of the cabinet adjacent the cold air generating chamber and a compressor positioned in the machine room. The machine room may be positioned above only the refrigerating compartment and the cold air generating chamber may be positioned above both the refrigerating compartment and the freezing compartment. The refrigerator may include a return duct that connects the storage compartment with the cold air generating compartment and that is configured to guide air from inside of the storage compartment toward the cold air generating compartment and a return unit configured to control air flow through the return duct.

In another aspect, a refrigerator includes a cabinet and a refrigerating compartment defined by the cabinet and having a surface that defines a top of at least one portion of the refrigerating compartment when the cabinet is oriented in an ordinary operating orientation. The refrigerator also includes a machine room having one or more compartments and being positioned at an upper portion of the cabinet. The upper portion of the cabinet is located at a vertical position that is higher than the surface of the refrigerating compartment when the cabinet is oriented in the ordinary operating orientation and the machine room occupies less than all of the upper portion of the cabinet. The refrigerator further includes one or more components of a heat exchange cycle that is configured to regulate temperature of the refrigerating compartment. The one or more components are positioned in the machine room. In addition, the refrigerator includes an additional storage compartment that is positioned at the upper portion of the cabinet adjacent to the machine room, that is separated from the machine room by at least one wall, and that includes an access opening that is configured to enable placement of items in and removal of items from the additional storage compartment. The refrigerator also includes at least one door configured to open and close the access opening of the additional storage compartment.

Implementations may include one or more of the following features. For example, the refrigerator may include a freezing compartment defined by the cabinet in parallel with the refrigerating compartment and having a surface that defines a top of the freezing compartment when the cabinet is oriented in an ordinary operating orientation. The surface of the freezing compartment may be located in a plane with the surface of the refrigerating compartment. The additional storage compartment may be positioned above only the freezing compartment and may be partitioned from the machine room by at least one wall that extends along an entire depth of the cabinet.

In some examples, the additional storage compartment may extend along an entire horizontal width of the cabinet, may be partitioned from the machine room by at least one wall that extends along an entire horizontal width of the cabinet, and may occupy a front portion of a depth of the upper portion of the cabinet. In these examples, the machine room occupy a rear portion of the depth of the upper portion of the cabinet. Further, at least a portion of the additional storage compartment may include an additional portion of the refrigerating compartment provided at the upper portion of the cabinet.

In yet another aspect, a control method of regulating temperature in a refrigerator includes supplying cold air to a refrigerating compartment and a freezing compartment. The cold air is generated by an evaporator positioned at an upper portion of a cabinet that defines the refrigerating compartment and the freezing compartment and the upper portion of the cabinet is located at a vertical position that is higher than the refrigerating compartment and the freezing compartment when the cabinet is oriented in an ordinary operating orientation. The method also includes accessing a first temperature measurement for the refrigerating compartment and accessing a second temperature measurement for the freezing compartment. The method further includes comparing the first temperature measurement to a first temperature threshold, comparing the second temperature measurement to a second temperature threshold, and determining whether the first temperature measurement is above the first temperature threshold and whether the second temperature measurement is above the second temperature threshold based on the comparisons. In addition, the method includes controlling flow of cold air generated by the evaporator to the refrigerating compartment, the freezing compartment, or both the refrigerating compartment and the freezing compartment based on the determination of whether the first temperature measurement is above the first temperature threshold and whether the second temperature measurement is above the second temperature threshold.

Implementations may include one or more of the following features. For example, the method may include controlling a first unit to open or close a first air flow passage between the refrigerating compartment and a cold air generating compartment configured to accommodate the evaporator and controlling a second unit to open or close a second air flow passage between the freezing compartment and the cold air generating compartment.

In some implementations, the method may include, based on a determination that the first temperature measurement for the refrigerating compartment is above the first temperature threshold and the second temperature measurement for the freezing compartment is below the second temperature threshold, allowing flow of cold air generated by the evaporator to the refrigerating compartment and stopping flow of cold air generated by the evaporator to the freezing compartment. The method also may include, based on a determination that the first temperature measurement for the refrigerating compartment is below the first temperature threshold and the second temperature measurement for the freezing compartment is above the second temperature threshold, stopping flow of cold air generated by the evaporator to the refrigerating compartment and allowing flow of cold air generated by the evaporator to the freezing compartment.

The method further may include, based on a determination that the first temperature measurement for the refrigerating compartment is below the first temperature threshold and the second temperature measurement for the freezing compartment is below the second temperature threshold, allowing flow of cold air generated by the evaporator to the refrigerating compartment and allowing flow of cold air generated by the evaporator to the freezing compartment. In addition, the method may include, based on a determination that the first temperature measurement for the refrigerating compartment is above the first temperature threshold and the second temperature measurement for the freezing compartment is above the second temperature threshold, allowing flow of cold air generated by the evaporator to the refrigerating compartment and allowing flow of cold air generated by the evaporator to the freezing compartment.

In some examples, the method may include monitoring a refrigerating compartment door position, a duration of when the refrigerating compartment door is oriented in an opened position, and a number of times the refrigerating compartment door has been opened in a first time period and monitoring a freezing compartment door position, a duration of when the freezing compartment door is oriented in an opened position, and a number of times the freezing compartment door has been opened in a second time period. In these examples, the method may include controlling flow of cold air generated by the evaporator to the refrigerating compartment, the freezing compartment, or both the refrigerating compartment and the freezing compartment based on the determination of whether the first temperature measurement is above the first temperature threshold and whether the second temperature measurement is above the second temperature threshold, based on the monitoring of the refrigerating compartment door position, the duration of when the refrigerating compartment door is oriented in the opened position, and the number of times the refrigerating compartment door has been opened in the first time period, and based on the monitoring of the freezing compartment door position, the duration of when the freezing compartment door is oriented in the opened position, and the number of times the freezing compartment door has been opened in the second time period.

Further, the method may include monitoring an amount of time that cold air generated by the evaporator has been controlled to flow to only a single compartment. The method may include controlling flow of cold air generated by the evaporator to the refrigerating compartment, the freezing compartment, or both the refrigerating compartment and the freezing compartment based on the determination of whether the first temperature measurement is above the first temperature threshold and whether the second temperature measurement is above the second temperature threshold and based on the monitoring of the amount of time that cold air generated by the evaporator has been controlled to flow to only a single compartment.

BRIEF DESCRIPTION OF THE DRAWINGS

FIG. 12 is a table illustrating example logic for the example control method shown in FIG. 11;

DETAILED DESCRIPTION

Techniques are described for arranging a machine room of a refrigerator at an uppermost part of a refrigerator body. By arranging the machine room at an uppermost part of the refrigerator body, a size of a refrigerating compartment and/or a freezing compartment may be increased because usable space of the refrigerating compartment and/or the freezing compartment is not taken up by the machine room and its components. For example, the machine room may be positioned at a relatively high location that is outside of a typical user's reach. In this example, because the machine is positioned outside of a typical user's reach and at a position that is not suitable for a refrigerating compartment and/or freezing compartment, the machine room does not take up space that is otherwise usable for the refrigerating compartment and/or the freezing compartment.

In some implementations, the machine room is vertically-partitioned into multiple cabinets or compartments across an uppermost part of a refrigerator body. In these implementations, when the refrigerator is a side-by-side type having a freezing compartment and a refrigerating compartment arranged side-by-side, a central cool air generation compartment may be part of the machine room and configured to distribute cool air to the freezing compartment and the refrigerating compartment (e.g., both sides of the refrigerator). In addition, when the refrigerator is the side-by-side type, heat producing components of the machine room (e.g., compressor) may be housed in a vertically-partitioned compartment that is positioned over the refrigerating compartment instead of the freezing compartment. Arranging the heat producing components of the machine room over only the refrigerating compartment (or having a majority of an area taken up by the heat producing components of the machine room being positioned over the refrigerating compartment rather than the freezing compartment) may lead to improved efficiency in cooling the refrigerator and energy savings. Moreover, a negative impact caused by an overheating failure of one or more of the heat producing components may be reduced when the failing component is positioned over the refrigerating compartment instead of freezing compartment because the additional heat generated by the failing component is less likely to spoil food in the refrigerating compartment.

In some examples, components of the machine room may not require the machine room to occupy an entirety of an uppermost portion of a refrigerator body. In these examples, the additional space of the uppermost portion of the refrigerator body that is not taken up by the machine room may be used to provide additional functionality. For instance, the additional space may be used as an additional storage compartment that is not cooled by the refrigerator or the additional space may be used as additional space for a refrigerating and/or freezing compartment of the refrigerator.

Figure 1:
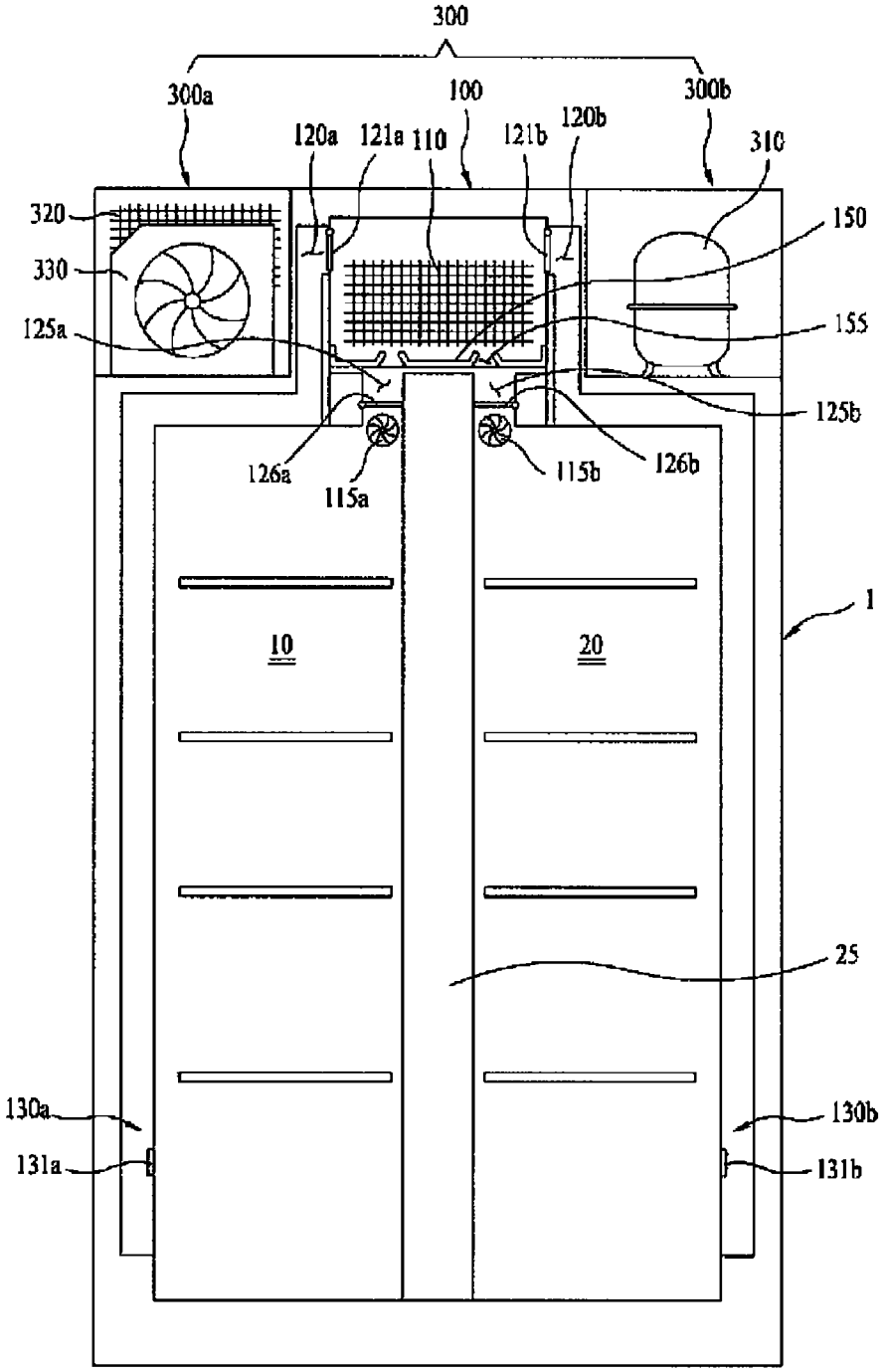
FIG. 1 is a front view illustrating a refrigerator.

FIG. 1 illustrates an example of a refrigerator that is oriented in an ordinary operating orientation. As shown in FIG. 1, a refrigerator includes a cabinet 1 having at least one storage compartment. As shown, the refrigerator includes a freezing compartment 10, a refrigerating compartment 20, and a cold air generating compartment 100 provided in an upper portion of the cabinet 1. The cold air generating compartment 100 is configured to supply cold air to each of the freezing compartment 10 and the refrigerating compartment 20.

In some examples, the freezing compartment 10 and the refrigerating compartment 20 are partitioned by a partition wall 25 and they are arranged side-by-side in parallel. In other examples, the freezing compartment 10 and the refrigerating compartment 20 have other orientations, such as a stacked configuration with an upper freezing compartment 10 and a lower refrigerating compartment 20 or a lower freezing compartment 10 and an upper refrigerating compartment 20.

A machine compartment 300 is positioned adjacent to the cold air generating compartment 100. The machine compartment 300 accommodates a compressor 310, a condenser 320, and a condensation fan 330. The machine compartment 300 has a first machine compartment 300*a* positioned next to the cold air generating compartment 100 and a second machine compartment 300*b* positioned next to the cold air generating compartment 100 on the opposite side. The first machine compartment 300*a* accommodates the condenser 320 and the condensation fan 330. The second machine compartment 300*b* accommodates the compressor 310.

Alternatively, a single machine compartment 300, instead of plural ones, may be provided in a predetermined portion of the cold air generating compartment 100. In this example, the single machine compartment 300 includes the compressor 310, the condenser 320, and the condensation fan 330.

As to an exterior appearance of the refrigerator, the height of the cold air generating compartment 100 may be identical to that of the machine compartment 300.

An evaporator 110 may be positioned within the cold air generating compartment 100 and configured to generate cold air. Cold air outlets 125*a* and 125*b* are defined between the cold air generating compartment 100 and the freezing compartment 10 and between the cold air generating compartment 100 and the refrigerating compartment 20, respectively. The cold air outlets 125*a* and 125*b* guide the cold air generated by the evaporator 110 toward the freezing and refrigerating compartments 10 and 20, respectively.

A water collecting tray 150 may be provided between the cold air outlets 125*a* and 125*b* and the evaporator 110 to receive defrost water generated by the evaporator 110. A cold air guiding recess 155 may be provided in the water collecting tray 150 to guide the cold air of the evaporator 110 toward the cold air outlets 125*a* and 125*b*.

Cold air fans 115*a* and 115*b* are positioned in the first and second cold air outlets 125*a* and 125*b*, respectively. The cold air fans 115*a* and 115*b* are configured to blow the cold air generated by the evaporator 110 into the freezing and refrigerating compartments 10 and 20, respectively.

The cold air outlets 125*a* and 125*b* may be a first cold air outlet 125*a* and a second cold air outlet 125*b* and the cold air fans 115*a* and 115*b* may be a first cold air fan 115*a* corresponding to the first cold air outlet 125*a* and a second cold air fan 115*b* corresponding to the second cold air outlet 125*b*. The cold air fans 115*a* and 115*b* may each be a cross-flow fan.

A closable damper 126*a* and 126*b* is positioned in each of the first and second cold air outlets 125*a* and 125*b*, respectively. The closable dampers 126*a* and 126*b* open and close the first and second cold air outlets 125*a* and 125*b*, respectively, such that cold air inside the cold air generating compartment 100 may be stopped from moving into the freezing or refrigerating compartment 10 or 20.

The closable dampers 126*a* and 126*b* include a first closable damper 126*a* provided in the first cold air outlet 125*a* and a second closable damper 126*b* provided in the second cold air outlet 125*b*.

In some implementations, the first closable damper 126*a* is rotatably mounted between the water collecting tray 150 and the first cold air fan 115*a* and the second closable damper 126*b* is rotatably mounted between the water collecting tray 150 and the second cold air fan 115*b*.

Alternatively, the first and second closable dampers 126*a* and 126*b* may be mounted under the first and second cold air fans 115*a* and 115*b*, respectively.

In some examples, the first and second cold air fans 115*a* and 115*b* are positioned directly under the cold air guiding recess 155 and installed in centers of the first and second cold air outlets 125*a* and 125*b*, respectively.

When the first and second cold air fans 115*a* and 115*b* rotate, cold air generated by the evaporator 110 is drawn by the first and second cold air fans 115*a* and 115*b* toward the freezing compartment 10 and refrigerating compartment 20, respectively. The cold air moves vertically downward into the freezing compartment 10 and refrigerating compartment 20 after passing the first and second cold air fans 115*a* and 115*b*, respectively.

Because the first and second cold air fans 115*a* and 115*b* rotate, some of the cold air moves vertically downward along the partition wall 25 and the other flows along the rotation direction such that the cold air may be supplied to the freezing and refrigerating compartments 10 and 20 uniformly.

Cold air inlets 120*a* and 120*b* may be defined in sides of the cold air generating compartment 100. The cold air inlets 120*a* and 120*b* draw cold air having passed through the freezing and refrigerating compartments 10 and 20 into the cold air generating compartment 100.

The cold air inlets 120*a* and 120*b* are each connected with a guiding duct 130*a* and 130*b* that guides the flow of the cold air inside the freezing and refrigerating compartments 10 and 20. The guiding ducts 130*a* and 130*b* may include a first guiding duct 130*a* connecting the freezing compartment 10 with the cold air generating compartment 100 and a second guiding duct 130*b* connecting the refrigerating compartment 20 with the cold air generating compartment 100.

The first and second guiding ducts 130*a* and 130*b* are arranged along side and upper walls of the freezing and refrigerating compartments 10 and 20 and side walls of the cold air generating compartment 100.

The cold air inlets 120*a* and 120*b* include a first cold air inlet 120*a* that draws cold air of the freezing compartment 10 and a second cold air inlet 120*b* that draws cold air of the refrigerating compartment 20.

First and second dampers 121*a* and 121*b* are positioned at the first and second cold air inlets 120*a* and 120*b*, respectively. The first and second dampers 121*a* and 121*b* are configured to open and close the first and second cold air inlets 120*a* and 120*b*, respectively, to selectively stop cold air moving into the cold air generating compartment 100 from the freezing or refrigerating compartment 10 or 20.

Figure 2:
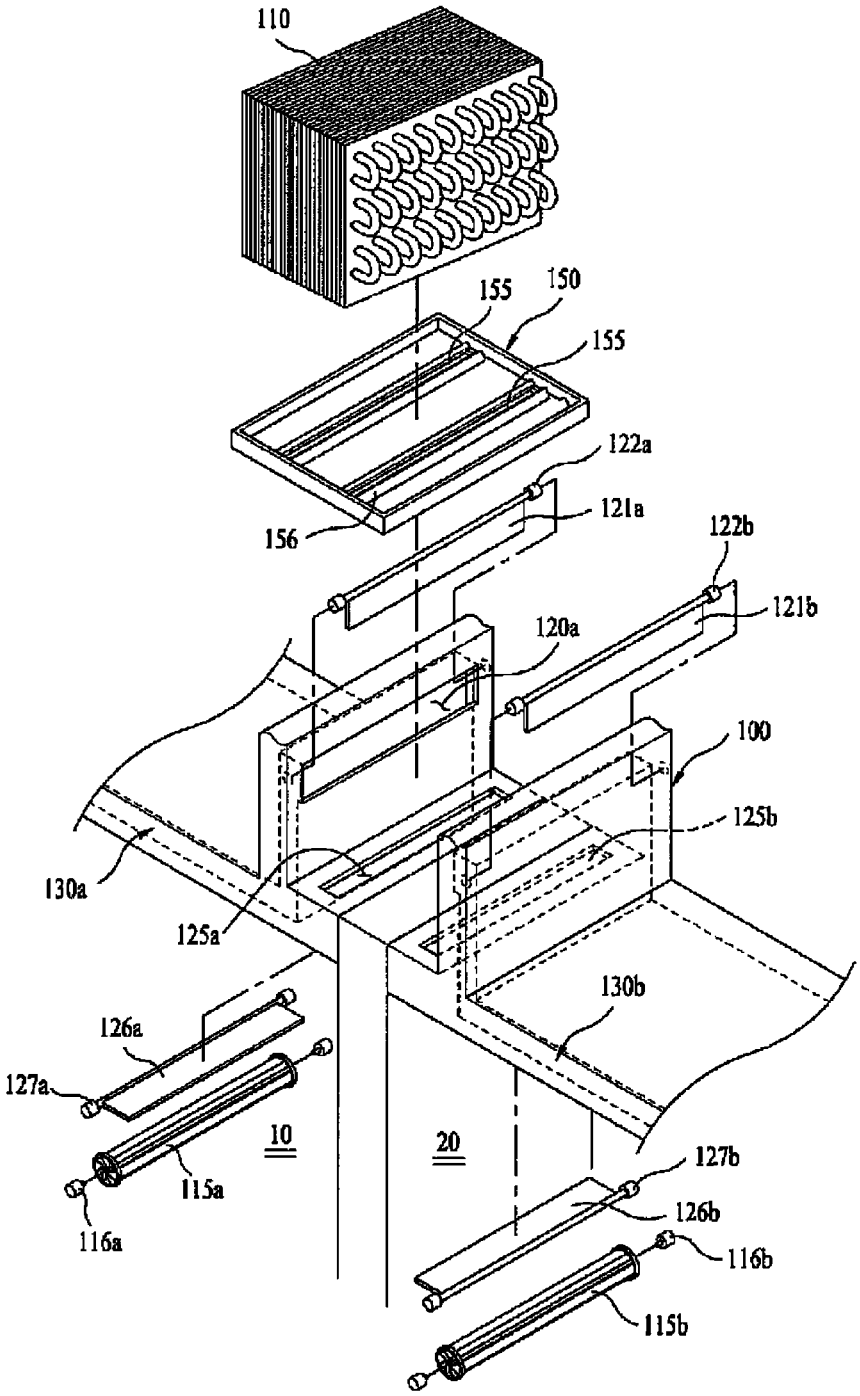
FIG. 2 is an exploded perspective view illustrating a cold air generating compartment of the refrigerator.

According to the inner structure of the cold air generating compartment 100 as shown in FIG. 2, the first and second cold air outlets 125*a* and 125*b* are defined in a bottom wall of the cold air generating compartment 100 such that the freezing compartment 10 may be in communication with the refrigerating compartment 20.

The first and second cold air fans 115*a* and 115*b* and the first and second closable dampers 126*a* and 126*b* are provided in the first and second cold air outlets 125*a* and 125*b*, respectively, as mentioned above. Driving members 116*a*, 116*b*, 127*a*, and 127*b* are provided in the first and second cold air fans 115*a* and 115*b* and the first and second closable dampers 126*a* and 126*b*, respectively, to drive the fans and closable dampers. The driving members 116*a*, 116*b*, 127*a*, and 127*b* may include motors. The first and second dampers 121*a* and 121*b* also include driving members 122*a* and 122*b* that drive the first and second dampers 121*a* and 121*b*, respectively.

The cold air generating compartment 100 may be provided over both of the freezing compartment 10 and the refrigerating compartment 20 to supply cold air of the cold air generating compartment 100 to both the freezing and refrigerating compartments 10 and 20 and, in some examples, uniformly.

The water collecting tray 150 may be provided over the first and second cold air outlets 125*a* and 125*b* and the cold air guiding recess 155 defined in the water collecting tray 150 may be positioned directly on (e.g., above) the first and second cold air outlets 125*a* and 125*b*.

In some implementations, a circumference of the cold air guiding recess 155 is surrounded by a projecting rib 156 to reduce (e.g., prevent) the defrost water collected in the water collecting tray 150 from leaking into the cold air guiding recess 155.

The evaporator 110 is provided on the water collecting tray 150 and the evaporator 110 may have an approximately hexagonal shape.

The first and second cold air inlets 120*a* and 120*b* are positioned at both sides of the evaporator 110, respectively. The first and second dampers 121*a* and 121*b* are positioned in the first and second cold air inlets 120*a* and 120*b*, respectively, as mentioned above.

The cold air generating compartment 100 is defined as an airtight space surrounded by insulation walls. The inlets and outlets are defined through the insulation walls to enable communication between the cold air generating compartment 100 and the freezing and refrigerating compartments 10 and 20.

The first and second guiding ducts 130*a* and 130*b* are positioned in both sides of the insulation walls that define the cold air generating compartment 100. The first and second cold air inlets 120*a* and 120*b* are defined at the end of the first and second guiding ducts 130*a* and 130*b*, respectively.

Figure 3:
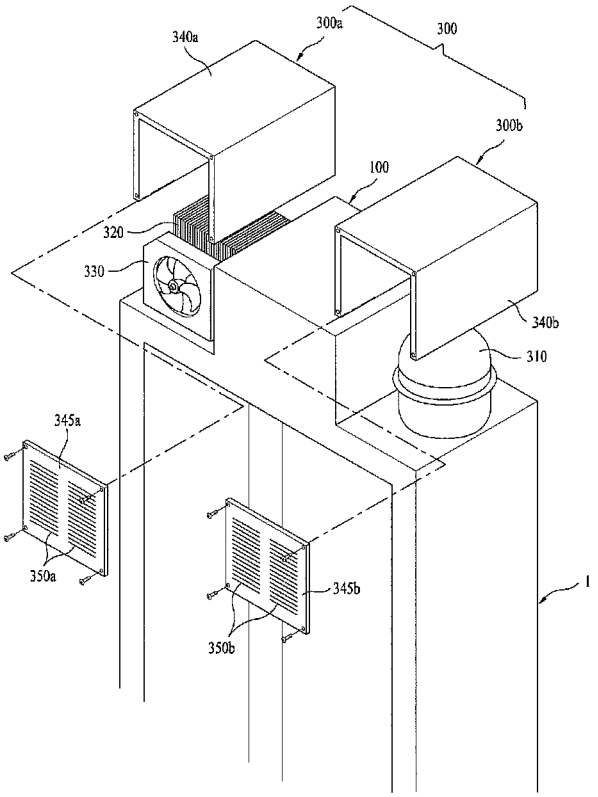
FIG. 3 is an exploded perspective view illustrating a machine compartment of the refrigerator.

As shown in FIG. 3, the first and second machine compartments 300*a* and 300*b* are positioned on both sides of the cold air generating compartment 100. The condenser 320 and the condensation fan 330 are provided in the first machine compartment 300*a* and the compressor 310 is provided in the second machine compartment 300*b*.

The first and second machine compartments 300*a* and 300*b* are defined by first and second housings 340*a* and 340*b*, respectively. First and second cover members 345*a* and 345*b* are installed to fronts of the first and second housings 340*a* and 340*b*, respectively, to reduce exposure of the insides of the machine compartments 300*a* and 300*b* to the outside.

A plurality of communication holes 350*a* and 350*b* may be provided in the first and second cover members 345*a* and 345*b*, respectively, to communicate internal air of the machine compartment 300 (300*a* and 300*b*) with external air.

Figure 4:
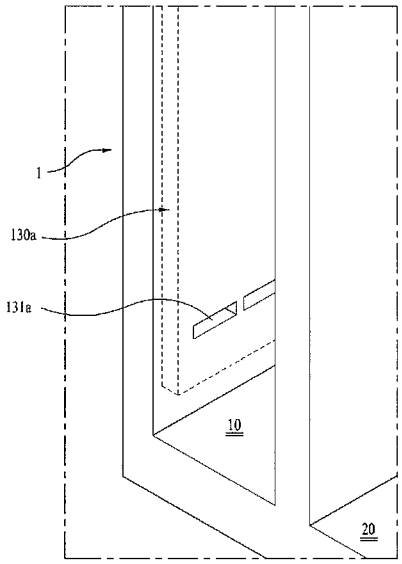
FIG. 4 is a perspective view illustrating a guiding duct installed in the refrigerator.

As shown in FIG. 4, the first guiding duct 130*a* is provided in the portion of the freezing compartment 10 and a first guiding hole 131*a* is defined at (e.g., in) an end portion of the first guiding duct 130*a* to draw air from inside the freezing compartment 10 into the first guiding duct 130*a*.

As a result, the air of the freezing compartment 10 drawn via the first guiding hole 131*a* flows along the first guiding duct 130*a* into the cold air generating compartment (100, see FIG. 1). Then, the air is re-supplied to the freezing compartment 10 by the first cold air fan (115*a*, see FIG. 1) after passing the evaporator (110, see FIG. 1).

This configuration and air circulation may be applicable to those of the refrigerating compartment 20, the second guiding duct 130*b*, and the second guiding hole 131*b* (see FIG. 1).

Figure 5:
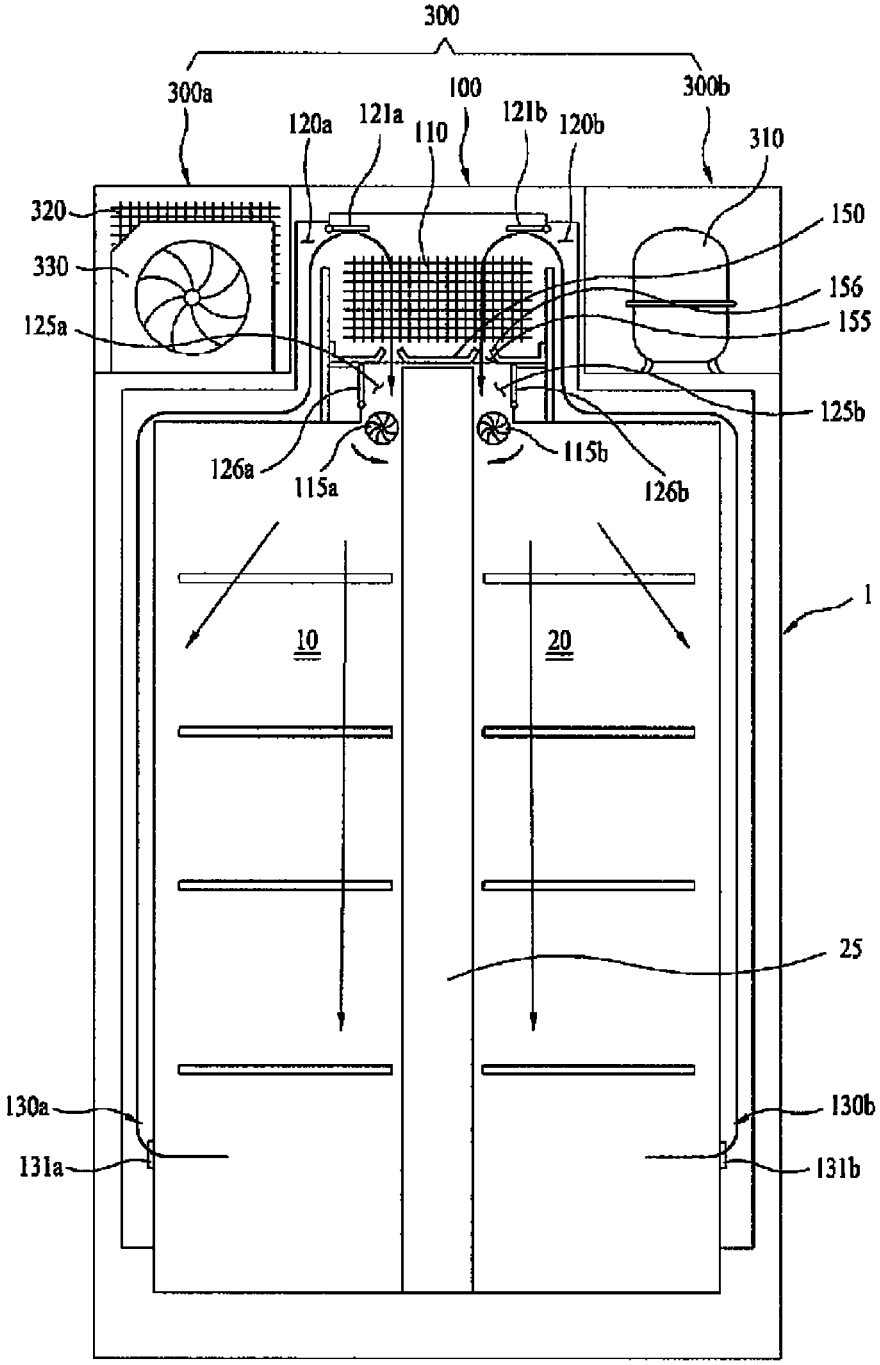
FIG. 5 is a front view illustrating cold air supplied to a freezing compartment and a refrigerating compartment provided in the refrigerator.

Examples of operation of the refrigerator are described below with respect to FIGS. 5-7. As shown in FIG. 5, once the compressor 310 operates, the refrigerant compressed by the compressor 310 flows into the condenser 320 in a state of the cold air being supplied to both of the freezing and refrigerating compartments 10 and 20.

The refrigerant inside the condenser 320 is condensed through cooling operation performed by the condensation fan 330. Then, the condensed refrigerant is decompressed and expanded through a predetermined expansion process, which results in low temperature and low pressure refrigerant. The low-temperature-and-low-pressure air is drawn into the evaporator 110.

Next, the first and second closable dampers 126*a* and 126*b* and the first and second dampers 121*a* and 121*b* are opened, the first and second cold air fans 115*a* and 115*h* rotate, and the cold air that has passed over the evaporator 110 is supplied to the freezing and refrigerating compartments 10 and 20.

The rotational direction of the first and second cold air fans 115*a* and 115*b* is toward each side of the partition wall 25 with respect to the front. As a result, the first cold air fan 115 provided in the freezing compartment 10 rotates in a clockwise direction and the second cold air fan 115*b* provided in the refrigerating compartment 20 rotates in a counter-clockwise direction.

Such rotation causes at least some of the cold air to move vertically downward along the partition wall 25. The cold air moved vertically downward along the partition wall 25 is employed as an 'air curtain' and some of the cold air is supplied to the freezing and refrigerating compartments 10 and 20 uniformly.

The cold air supplied to the freezing and refrigerating compartments 10 and 20 moves to the lower portions of the freezing and refrigerating compartments 10 and 20, and the cold air is re-supplied to the cold air generating compartment 100, after being drawn into the first and second guiding ducts 130*a* and 130*b*.

Because the first and second cold air fans 115*a* and 115*b* are rotating continuously, the cold air generating compartment 100 is at a low pressure in comparison to the lower portion of the freezing or refrigerating compartment 10 or 20 and thus the air in the lower portion of the freezing or refrigerating compartment 10 or 20 moves into the cold air generating compartment 100 along the first and the second guiding duct 130*a* and 130*b*.

Figure 6:
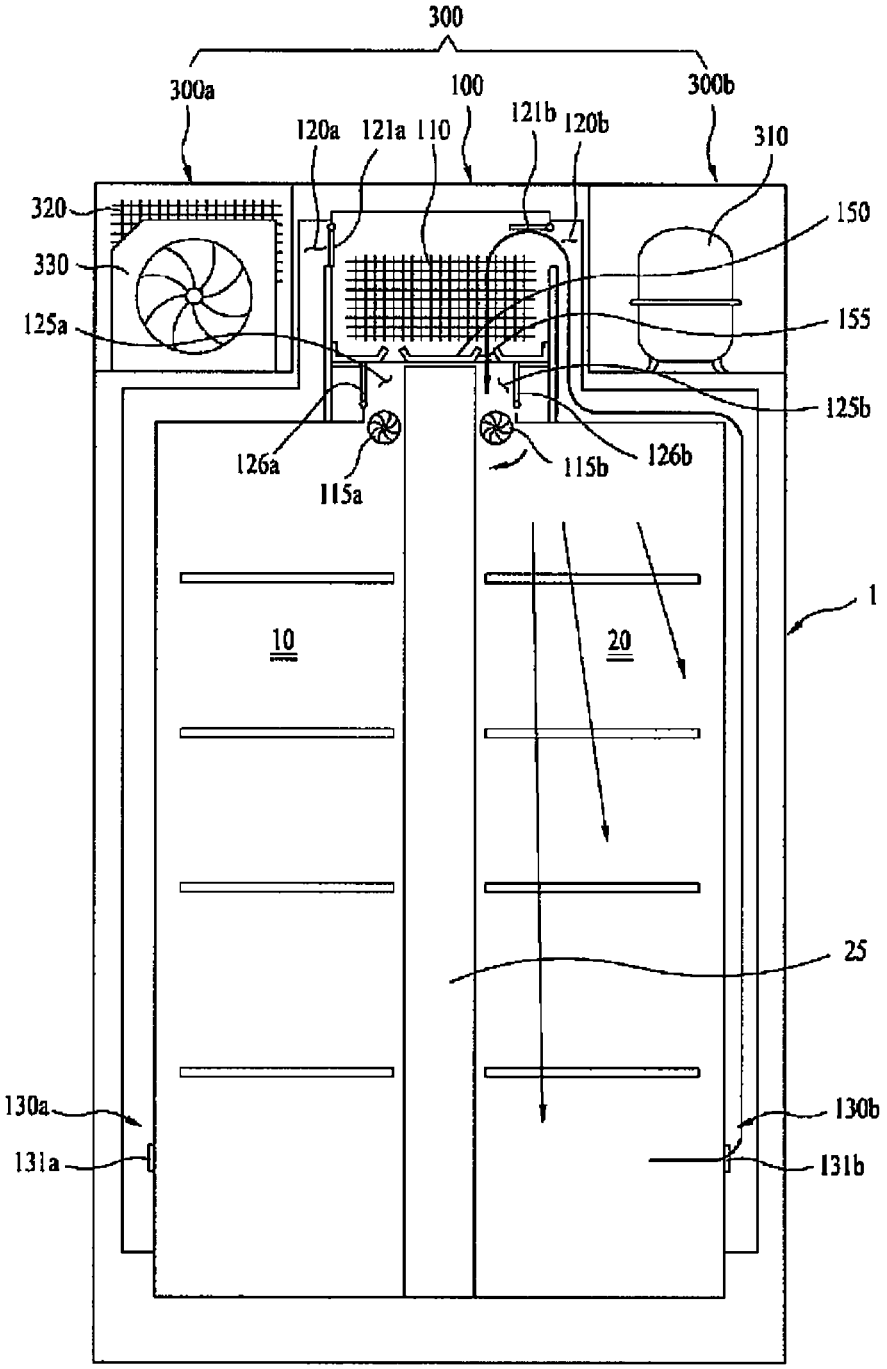
FIG. 6 is a front view illustrating cold air supplied to the refrigerating compartment.

As shown in FIG. 6, if the temperature inside the refrigerating compartment 20 increases suddenly out of a predetermined range kept by the normal supply of the cold air to the freezing and refrigerating compartments 10 and 20, the refrigerator may be controlled to supply cold air to the refrigerating compartment 20 at a higher volume or intensity.

In this example, the first closable damper 126*a* for the freezing compartment 20 closes the first cold air outlet 125*a* and the operation of the first cold air fan 115*a* is stopped temporarily.

The open state of the second closable damper 126*b* and the operation of the second cold air fan 115*b* is maintained. Based on this configuration, the cold air having passed over the evaporator 110 is supplied to the refrigerating compartment 20 at a higher volume or intensity to decrease the temperature inside the refrigerating compartment 20 such that the temperature may return to the normal range.

If the temperature inside the refrigerating compartment 20 is in the normal range, the first cold air fan 115*a* re-operates and the first damper 126*a* is open to re-draw the cold air into the freezing compartment 10.

Figure 7:
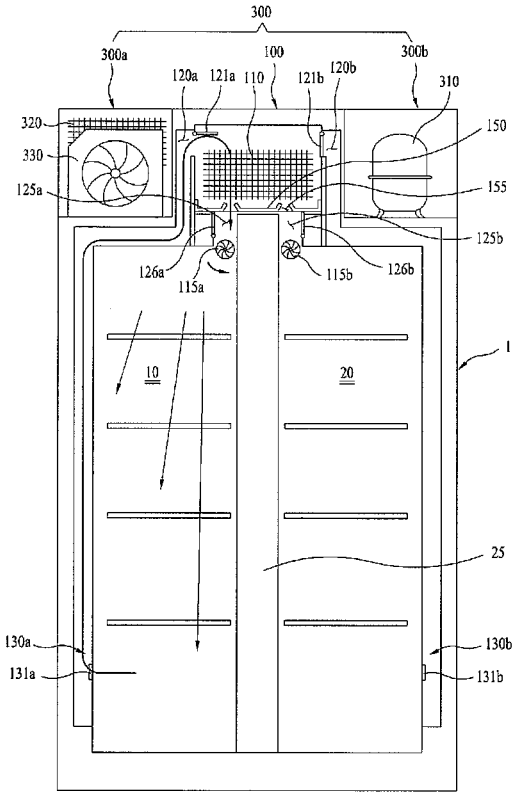
FIG. 7 is a front view illustrating cold air supplied to the freezing compartment.

FIG. 7 illustrates an opposite case to the case of FIG. 6. Specifically, if a storing object having a relatively high temperature is put in the freezing compartment 10, the temperature inside the freezing compartment 10 may increase drastically out of a predetermined range kept for the normal supply of the cold air to the freezing and refrigerating compartments 10 and 20.

In this example, the refrigerator may be controlled to perform the intensive supply of cold air to the freezing compartment 10.

For instance, the second closable damper 126*b* for the refrigerating compartment 20 closes the second cold air outlet 125*b* and the operation of the second cold air fan 115*b* is stopped temporarily.

The open state of the first closable damper 126*a* and the operation of the first cold air fan 125*a* is maintained. Based on this configuration, the cold air having passed over the evaporator 110 is supplied to the freezing compartment 10 at a higher volume or intensity and the temperature inside the freezing compartment 10 decreases such that the temperature inside the freezing compartment 10 may return to the normal range.

If the temperature inside the freezing compartment 10 is in the normal range, the second cold air fan 125*b* re-operates and the second closable damper 126*b* re-opens to re-draw the cold air into the refrigerating compartment 20.

Figure 8:
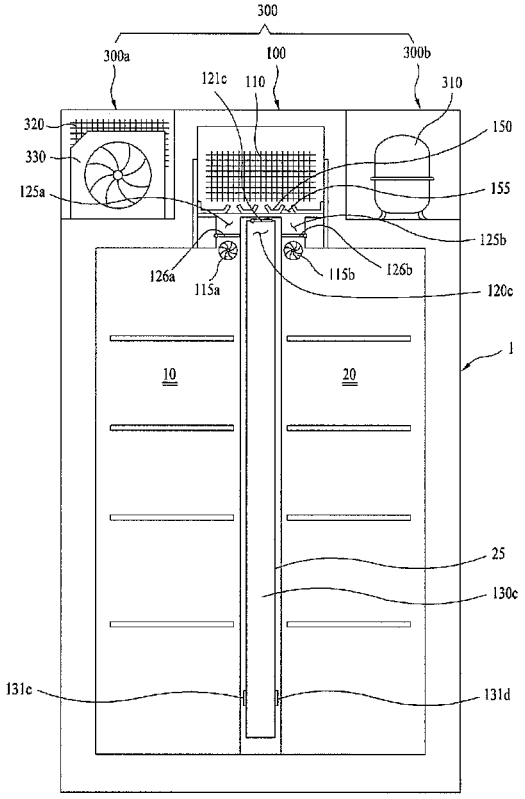
FIG. 8 is a front view illustrating an example refrigerator.

FIG. 8 illustrates another example of a refrigerator. As shown, instead of having separate guiding ducts 130*a* and 130*b* for the freezing and refrigerating compartments 10 and 20, respectively, the refrigerator has a shared guiding duct 130*c* that guides are from each of the freezing and refrigerating compartments 10 and 20 to the cold air generating compartment 100. The shared guiding duct 130*c* is positioned within the barrier 25 between the freezing and refrigerating compartments 10 and 20. The shared guiding duct 130*c* includes a freezing compartment guiding hole 131*c* and a refrigerating compartment guiding hole 131*d*. The freezing compartment guiding hole 131*c* allows air from the freezing compartment 10 to enter the shared guiding duct 130*c* and the refrigerating compartment guiding hole 131*d* allows air from the refrigerating compartment 20 to enter the shared guiding duct 130*c*.

A cold air inlet 120*c* is defined in a bottom wall of the cold air generating compartment 100. The cold air inlet 120*c* draws cold air having passed through the freezing and refrigerating compartments 10 and 20 into the cold air generating compartment 100. The cold air inlet 120*c* is connected with the guiding duct 130*c*. The water collecting tray 150 includes an opening that corresponds to the cold air inlet 120*c* to enable air to pass into the cold air generating compartment 100 through the cold air inlet 120*c*.

A damper 121*c* is positioned at the cold air inlet 120*c*. The damper 121*c* is configured to open and close the cold air inlet 120*c* to selectively stop cold air moving into the cold air generating compartment 100 from the freezing and/or refrigerating compartments 10 and 20.

Figure 9:
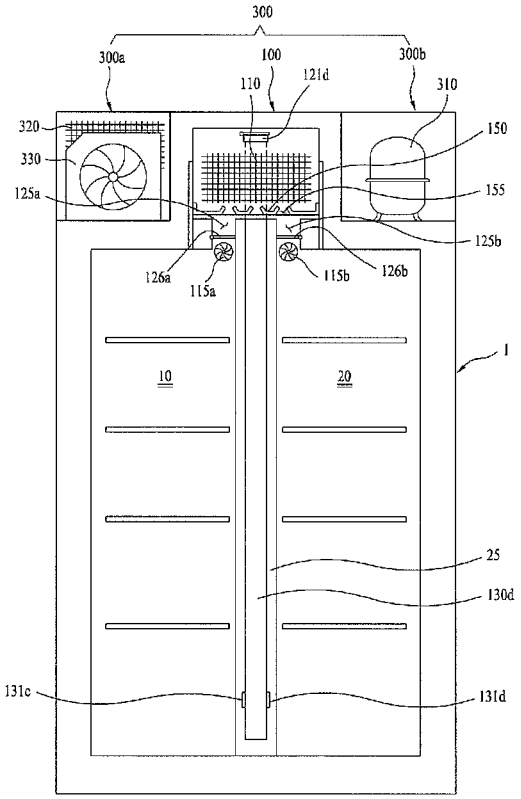
FIG. 9 is a front view illustrating an example refrigerator.

FIG. 9 illustrates another example of a refrigerator having a shared guiding duct 130*c*. As shown, rather than interfacing with a cold air inlet defined in a bottom wall of the cold air generating compartment 100, the shared guiding duct 130*c* interfaces with the cold air generating compartment 100 through a cold air inlet defined at an upper portion of a rear wall of the cold air generating compartment 100. In this example, the shared guiding duct 130*c* runs behind the cold air generating compartment 100 to supply air to an upper portion of the cold air generating compartment 100. Supplying air to the upper portion of the cold air generating compartment 100 may increase circulation and heat transfer and also does not require modification (e.g., reduction of an area covered by) the water collecting tray 150.

A damper 121*d* is positioned at the cold air inlet defined at the upper portion of the rear wall of the cold air generating compartment 100. The damper 121*d* is configured to open and close the cold air inlet to selectively stop cold air moving into the cold air generating compartment 100 from the freezing and/or refrigerating compartments 10 and 20.

Figure 10:
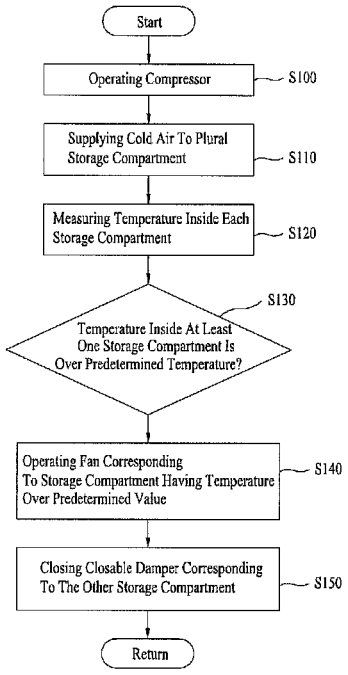
FIG. 10 is a flow chart illustrating an example control method of a refrigerator.

FIG. 10 illustrates an example control method of the above-described refrigerators. First, the compressor operates (S100) and cold air is supplied to the plurality of storage compartments, specifically, the freezing and refrigerating compartments (S110).

After the temperature inside each of the storage compartments is measured (S120), it is determined whether the temperature inside at least one storage compartment is over a predetermined temperature (S130).

The closable damper corresponding to the storage compartment having the temperature over the predetermined value is opened or maintained in an open state, if already open (S140) according to the result of the determination.

To supply the cold air at a higher volume or intensity to the storage compartment having the abnormal temperature, the closable damper corresponding to the other storage compartment is closed (S150).

If the temperature inside the storage compartment having the abnormal temperature distribution returns to a normal value, the refrigerator re-operates normally.

Figure 11:
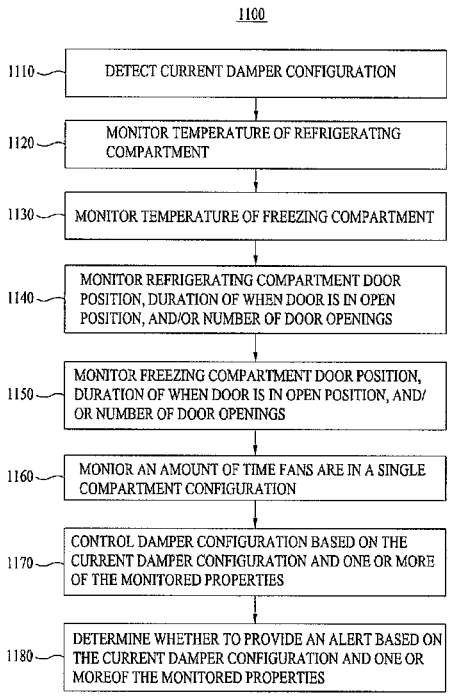
FIG. 11 is a flow chart illustrating an example control method of a refrigerator.

FIG. 11 illustrates another example process 1100 of controlling a refrigerator. The process 1100 accounts for temperature, door orientation measurements, and damper configuration measurements in controlling a damper configuration of a refrigerator. The process 1100 may be performed by a control unit (e.g., processor, computer, etc.) of a refrigerator.

The control unit detects a current damper configuration (1110). For example, the control unit detects whether a freezing compartment damper (e.g., damper 126*a*) that controls air flow to the freezing compartment is opened or closed and whether a refrigerating compartment damper (e.g., damper 126*b*) that controls air flow to the refrigerating compartment is opened or closed. The control unit may detect the current damper configuration by accessing data from one or more sensors configured to sense whether the freezing compartment damper is opened or closed and whether refrigerating compartment damper is opened or closed. The control unit may detect the current damper configuration by accessing stored data (e.g., one or more settings, one or more state variables, etc.) that indicates whether the freezing compartment damper has been controlled to be in an opened or closed position and whether the refrigerating compartment damper has been controlled to be in an opened or closed position.

The control unit monitors temperature of the refrigerating compartment (1120). For instance, the control unit accesses a temperature measurement from a temperature sensor configured to measure a temperature of the refrigerating compartment and compares the accessed temperature measurement to a range of one or more acceptable temperature measurements. Based on the comparison, the control unit determines whether the temperature measurement is within the range of one or more acceptable temperature measurements, below the range of one or more acceptable temperature measurements, or above the range of one or more acceptable temperature measurements. The control unit may periodically or continuously monitor a temperature of the refrigerating compartment.

The control unit monitors temperature of the freezing compartment (1130). For instance, the control unit monitors temperature of the freezing compartment using techniques similar to those described above with respect to reference numeral 1120.

The control unit monitors a refrigerating compartment door position, a duration of when the refrigerating compartment door is oriented in an opened position, and/or a number of times the refrigerating compartment door has been opened in a given time period (1140). For instance, the control unit monitors a refrigerating compartment door position by accessing data from one or more sensors configured to sense whether the refrigerating compartment door is oriented in an opened position or a closed position. Based on the sensor data, the control unit determines whether the refrigerating compartment door is oriented in an opened position or a closed position. The control unit may periodically or continuously monitor a position of the refrigerating compartment door.

The control unit also monitors a duration of when the refrigerating compartment door is oriented in an opened position. For example, when the control unit first detects that the refrigerating compartment door has moved from a closed position to an opened position, the control unit may start a timer to measure a time that refrigerating compartment door remains opened or the control unit may log the time when the control unit detected that the refrigerating compartment door moved from a closed position to an opened position. When the control unit uses a timer to measure an open time of the refrigerating compartment door, the control unit periodically or continuously checks the timer to determine whether the refrigerating compartment door has been oriented in an opened position more than a threshold amount of time. When the control unit logs an opened time of the refrigerating compartment door, the control unit periodically or continuously compares the opened time to a current time to determine whether the refrigerating compartment door has been oriented in an opened position more than a threshold amount of time. When the control unit detects that the refrigerating compartment door has moved back to a closed position, the control unit ends monitoring of the door open duration, resets the monitoring data, and awaits another detection of the refrigerating compartment door moving from a closed position to an opened position.

The control unit further monitors a number of times the refrigerating compartment door has been opened in a given time period. For example, each time the control unit detects that the refrigerating compartment door has moved from a closed position to an opened position, the control unit updates data to track the door opening (e.g., increments a counter). The control unit may only consider detected door openings within a given past period of time (e.g., door openings in the last half hour or ten minutes) in determining the number. As time passes, the control unit reduces the number of detected door openings (e.g., decrements or resets a counter). The control unit periodically or continuously compares the number of door openings to a threshold number to determine whether the number of door openings exceeds the threshold.

The control unit monitors a freezing compartment door position, a duration of when the freezing compartment door is oriented in an opened position, and/or a number of times the freezing compartment door has been opened in a given time period (1150). For instance, the control unit monitors a freezing compartment door position, a duration of when the freezing compartment door is oriented in an opened position, and/or a number of times the freezing compartment door has been opened in a given time period using techniques similar to those described above with respect to reference numeral 1140.

The control unit monitors an amount of time the dampers have been in a single compartment configuration (1160). For example, when the control unit controls the dampers to implement a single compartment configuration (e.g., only the refrigerating compartment or only the freezing compartment receives cooled air), the control unit may start a timer to measure a time that the single compartment configuration exists or the control unit may log the time when the control unit controlled the dampers to implement the single compartment configuration. When the control unit uses a timer to measure a single compartment configuration time, the control unit periodically or continuously checks the timer to determine whether the dampers have been oriented in a single compartment configuration more than a threshold amount of time. When the control unit logs a single compartment configuration start time, the control unit periodically or continuously compares the start time to a current time to determine whether the dampers have been oriented in a single compartment configuration more than a threshold amount of time. When the control unit controls the dampers to return to a dual compartment configuration, the control unit ends monitoring of the single compartment configuration, resets the monitoring data, and awaits another instance where the dampers are controlled to implement a single compartment configuration.

The control unit controls damper configuration based on the current damper configuration and one or more of the monitored properties (1170). For instance, the control unit controls the damper configuration based on the monitored temperature of the refrigerating compartment, the monitored temperature of the freezing compartment, the monitored door open position of the refrigerating compartment door, the monitored door open duration of the refrigerating compartment door, the monitored number of door openings of the refrigerating compartment door, the monitored door open position of the freezing compartment door, the monitored door open duration of the freezing compartment door, the monitored number of door openings of the freezing compartment door, and/or the monitored amount of time in a single compartment configuration.

In one example, the control unit determines that the monitored temperature of the freezing compartment exceeds a threshold temperature (e.g., has increased above a range of acceptable temperatures) and that the control unit should control the dampers to implement a freezing compartment only configuration to promote cooling of the freezing compartment. However, the control unit also determines that the freezing compartment door is oriented in an opened position (or has been oriented in an opened position for more than a threshold amount of time or has been opened more than a threshold number of times in the past ten minutes). To avoid sending a large amount of cool air through the opened door of the freezing compartment, the control unit determines not to control the dampers to implement a freezing compartment only configuration. Instead, in this example, the control unit controls the freezing compartment damper to close to reduce an amount of cooled air that escapes through the opened door of the freezing compartment. Accounting for the monitored door position (or other properties related to door monitoring), may improve the efficiency of the refrigerator and conserve energy.

In another example, the control unit has determined that the monitored temperature of the refrigerating compartment exceeds a threshold temperature (e.g., has increased above a range of acceptable temperatures) and has controlled the dampers to implement a refrigerating compartment only configuration to promote cooling of the refrigerating compartment. After implementing the refrigerating compartment only configuration, the control unit continues to monitor the temperature of the refrigerating compartment and monitors the amount of time the dampers have been oriented in the refrigerating compartment only configuration. Based on the continued monitoring, the control unit determines that the temperature of the refrigerating compartment remains above the threshold temperature and the damper configuration has been in the refrigerating compartment only configuration for more than a threshold amount of time. Based on this determination, the control unit determines that some aspect of cooling the refrigerating compartment appears to be malfunctioning. Accordingly, the control unit removes the refrigerating compartment only configuration and controls the dampers to implement a dual compartment configuration or a freezing compartment only configuration.

FIG. 12 illustrates example logic 1200 for controlling the damper configuration based on the current damper configuration and one or more of the monitored properties as described above with respect to reference numeral 1170. As shown, the logic 1200 includes a current damper configuration column 1210, a temperature column 1220, a door position column 1230, a door open duration column 1240, a number of door openings column 1250, an amount of time in a single compartment configuration column 1260, and a set damper configuration column 1270. The current damper configuration column 1210 stores values for a damper position (e.g., open or closed) of the freezing compartment damper and the refrigerating compartment damper. The values in the current damper configuration column 1210 are compared to detected damper configurations by the control unit.

The temperature column 1220 stores values for a temperature (e.g., within a proper operating range, below the proper operating range, or above the proper operating range) of the freezing compartment and the refrigerating compartment. The values in the temperature column 1220 are compared to monitored temperatures of the freezing and refrigerating compartments by the control unit. The door position column 1230 stores values for a door position (e.g., open or closed) of the freezing compartment door and the refrigerating compartment door. The values in the door position column 1230 are compared to monitored positions of the freezing and refrigerating compartment doors by the control unit.

The door open duration column 1240 stores values for a duration that the freezing compartment door and the refrigerating compartment door are oriented in an opened position (e.g., a particular duration or greater than/less than a limit threshold). The values in the door open duration column 1240 are compared to monitored open durations of the freezing and refrigerating compartment doors by the control unit. The number of door openings column 1250 stores values for a number of door openings (e.g., a particular number or greater than/less than a limit threshold) of the freezing compartment door and the refrigerating compartment door. The values in the number of door openings column 1250 are compared to monitored door openings of the freezing and refrigerating compartment doors by the control unit.

The amount of time in a single compartment configuration column 1260 stores values for an amount of time that the dampers are in a single compartment configuration (e.g., a particular amount of time or greater than/less than a limit threshold). The values in the amount of time in a single compartment configuration column 1260 are compared to monitored single compartment configuration times by the control unit.

The set damper configuration column 1270 indicates a damper configuration setting that the control unit uses when the monitored properties match a particular row in the logic 1200. For instance, the control unit compares the monitored properties (e.g., temperature, door position, etc.) to the logic 1200 and, when the control unit finds a matching row, the control unit controls the dampers to have the configuration defined in the set damper configuration column 1270 for the matching row.

Although several example rows are shown in FIG. 12, the logic 1200 may include more or fewer rows and have different configuration data or rules. In addition, the logic 1200 may include more or fewer columns of data. The logic 1200 is stored in electronic storage and accessed by the control unit in determining how to control the dampers.

Referring again to FIG. 11, the control unit determines whether to provide an alert based on the current damper configuration and one or more of the monitored properties (1180). For instance, in certain circumstances, the control unit determines that a malfunction appears to have occurred or that a particular inefficiency is present. In these circumstances, the control unit provides an alert to a user to alert the user to the suspected malfunction or the particular inefficiency.

In one example, when the control unit determines that a temperature of the refrigerating compartment remains above a threshold temperature despite a damper configuration having been in the refrigerating compartment only configuration for more than a threshold amount of time, the control unit determines that a malfunction in some aspect of cooling the refrigerating compartment is likely. Based on the determination that a malfunction in some aspect of cooling the refrigerating compartment is likely, the control unit provides an alert to a user indicating that a malfunction of the refrigerating compartment is suspected. The alert may indicate that the temperature of the refrigerating compartment remained above the threshold temperature despite the damper configuration having been in the refrigerating compartment only configuration for more than the threshold amount of time.

In another example, when the control unit determines that the freezing compartment door has been oriented in an opened position for more than a threshold amount of time, the control unit provides an alert to a user indicating that an inefficiency exists. The alert may indicate that the freezing compartment door has been oriented in an opened position for more than a threshold amount of time. The alert also may indicate that cooling to the freezing compartment has been stopped because the freezing compartment door has been oriented in an opened position for more than a threshold amount of time.

The alerts provided by the control unit may be visual output provided on a display (e.g., a liquid crystal display (LCD) screen) and/or audible output provided by a speaker. When the refrigerator includes a network connection, the control unit may provide an alert in an electronic communication (e.g., an electronic mail message) over a network (e.g., the Internet).

Figure 13:
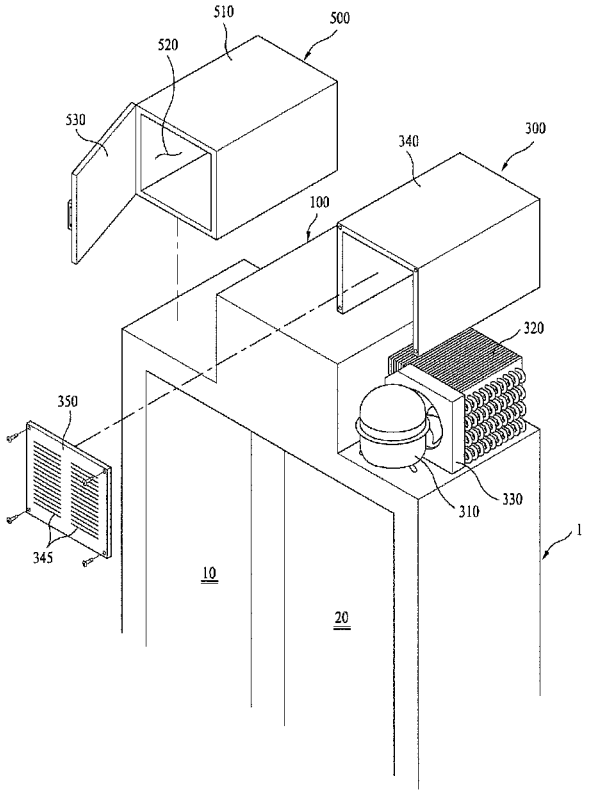
FIG. 13 is a perspective view illustrating a storage device installed in a refrigerator.

FIG. 13 illustrates a refrigerator according to another example. As shown in FIG. 13, the refrigerator is different from the above examples in which the machine compartment 300 is positioned on both sides of the cold air generating compartment 100. Specifically, in this example, the machine compartment 300 is provided on a side of the cold air generating compartment 100 and a storage device 500 is provided on the other side of the cold air generating compartment 100. The storage device 500 includes storage space 520 able to receive predetermined storing objects.

The storage device 500 includes a housing 510 defining the predetermined storage space 520 and a closable door 530 opening a front of the housing 510.

In consideration to the exterior appearance of the refrigerator, the height of the storage device 500 may be identical to the heights of the cold air generating compartment 100 and the machine compartment 300.

In other examples, instead of including the storage device 500, the refrigerator may have an extended or enlarged freezing compartment. In these examples, the freezing compartment 10 may extend into the space on the other side of the cold air generating compartment 100 shown as being occupied by the storage device 500 in FIG. 13. Accordingly, the additional space resulting from a smaller machine room may be used to increase capacity of the freezing compartment.

Figure 14:
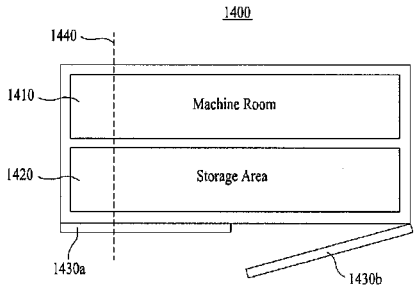
FIG. 14 is a top view illustrating an example refrigerator.

FIG. 14 illustrates an example refrigerator having a machine room that does not occupy an entire upper portion of a refrigerator body. In this example, the machine room 1410 is horizontally-partitioned in the upper portion of the refrigerator body. The machine room 1410 has been moved to a rear portion of the refrigerator body opposite of an access opening of the refrigerator and the doors of the refrigerator. Based on the positioning of the machine room 1410, additional space in the upper portion of the refrigerator body remains across a front portion of the refrigerator body. In this example, a storage area or device 1420 is positioned in the additional space that is not occupied by the machine room 1410. The storage area or device 1420 is not cooled and may be used by a user to store items, such as cookware, etc. The storage area or device 1420 is opened and closed by a pair of doors 1430*a* and 1430*b*. Although the pair of doors 1430*a* and 1430*b* are shown as being coupled to the refrigerator by hinges, the pair of doors 1430*a* and 1430*b* also may slide or being configured to tilt up and down.

Figure 15:
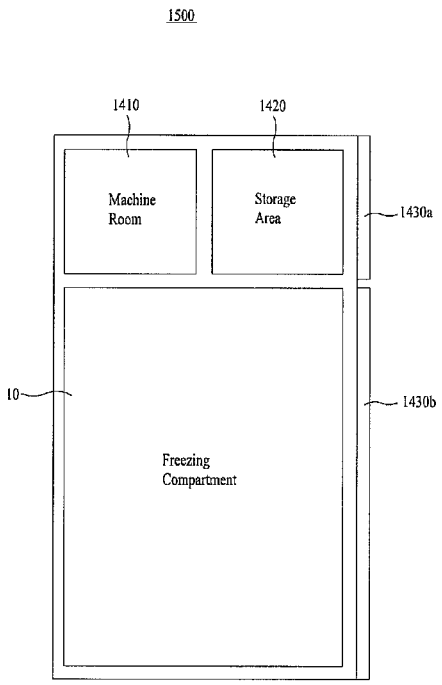
FIG. 15 is a side view illustrating a cross-section of the example refrigerator shown in FIG. 14 taken along line 1440.

FIG. 15 illustrates a cross-section of the example refrigerator shown in FIG. 14 taken along line 1440. As shown, the machine room 1410 and the storage area or device 1420 are positioned at an upper portion of the refrigerator body above the freezing compartment and are horizontally partitioned. The machine room 1410 is positioned at a rear of the upper portion of the refrigerator body and the storage area or device 1420 is positioned at a front of the upper portion of the refrigerator body.

Figure 16:
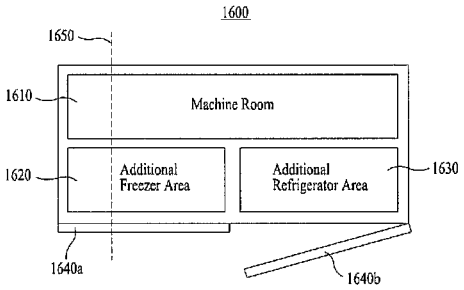
FIG. 16 is a top view illustrating an example refrigerator.

FIG. 16 illustrates another example refrigerator having a machine room that does not occupy an entire upper portion of a refrigerator body. In this example, the machine room 1610 is horizontally-partitioned in the upper portion of the refrigerator body. The machine room 1610 has been moved to a rear portion of the refrigerator body opposite of an access opening of the refrigerator and the doors of the refrigerator. Based on the positioning of the machine room 1610, additional space in the upper portion of the refrigerator body remains across a front portion of the refrigerator body. In this example, an additional freezer area 1620 and an additional refrigerating area 1630 are positioned in the additional space that is not occupied by the machine room 1610. The additional freezer area 1620 provides additional freezing compartment 10 space and the additional refrigerating area 1630 provides additional refrigerating compartment 20 space. The additional freezer area 1620 is opened and closed by a first door 1640*a* and the additional refrigerating area 1630 is opened and closed by a second door 1640*b*.

Figure 17:
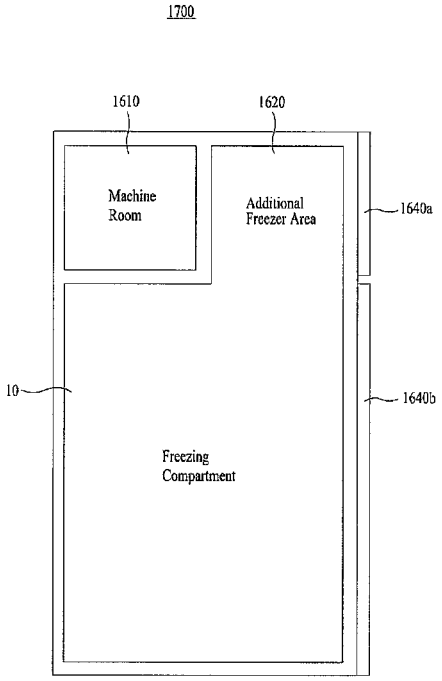
FIG. 17 is a side view illustrating an example cross-section of the example refrigerator shown in FIG. 16 taken along line 1650.

FIG. 17 illustrates a cross-section of the example refrigerator shown in FIG. 16 taken along line 1650. As shown, the machine room 1610 and the additional freezer area 1620 are positioned at an upper portion of the refrigerator body and are horizontally partitioned. The machine room 1610 is positioned at a rear of the upper portion of the refrigerator body and the additional freezer area 1620 is positioned at a front of the upper portion of the refrigerator body. The additional freezer area 1620 is an extension of the freezing compartment 10. In some implementations, an ice maker and/or an ice storage bin may be positioned in the additional freezer area 1620. As shown in FIG. 17, the door 1640*a* opens and closes only the additional freezer area 1620 and another freezing compartment door is provided.

Figure 18:
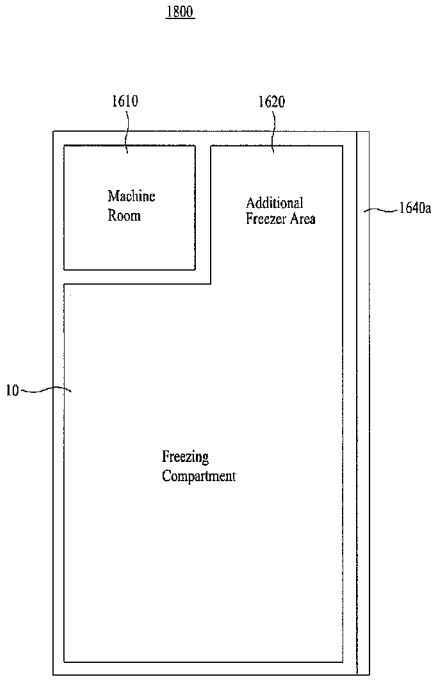
FIG. 18 is a side view illustrating another example cross-section of the example refrigerator shown in FIG. 16 taken along line 1650.

FIG. 18 illustrates another example cross-section of the example refrigerator shown in FIG. 16 taken along line 1650. In this example, the door 1640*a* opens and closes the additional freezer area 1620 and a remainder of the freezing compartment 10.

Figure 19:
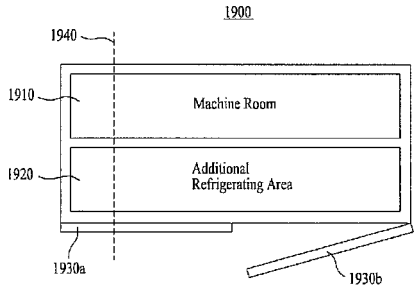
FIG. 19 is a top view illustrating an example refrigerator.

FIG. 19 illustrates an example of a bottom freezer type refrigerator having a machine room that does not occupy an entire upper portion of a refrigerator body. In this example, the machine room 1910 is horizontally-partitioned in the upper portion of the refrigerator body. The machine room 1910 has been moved to a rear portion of the refrigerator body opposite of an access opening of the refrigerator and the doors of the refrigerator. Based on the positioning of the machine room 1910, additional space in the upper portion of the refrigerator body remains across a front portion of the refrigerator body. In this example, an additional refrigerating area 1920 is positioned in the additional space that is not occupied by the machine room 1910. The additional refrigerating area 1920 provides additional refrigerating compartment space. The additional refrigerating area 1920 is opened and closed by a pair of doors 1930*a* and 1930*b*. Although the pair of doors 1930*a* and 1930*b* are shown as being coupled to the refrigerator by hinges, the pair of doors 1930*a* and 1930*b* also may slide or being configured to tilt up and down.

Figure 20:
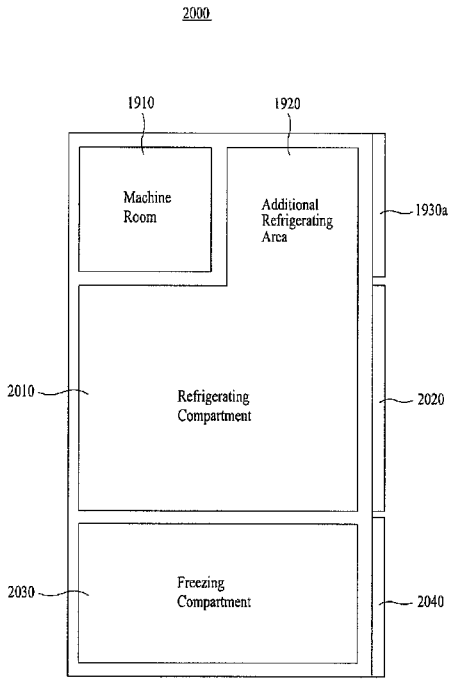
FIG. 20 is a side view illustrating an example cross-section of the example refrigerator shown in FIG. 19 taken along line 1940.

FIG. 20 illustrates a cross-section of the example refrigerator shown in FIG. 19 taken along line 1940. As shown, the machine room 1910 and the additional refrigerating area 1920 are positioned at an upper portion of the refrigerator body and are horizontally partitioned. The machine room 1910 is positioned at a rear of the upper portion of the refrigerator body and the additional refrigerating area 1920 is positioned at a front of the upper portion of the refrigerator body. The additional refrigerating area 1920 is an extension of a refrigerating compartment 2010. As shown in FIG. 20, the door 1930*a* opens and closes only the additional refrigerating area 1920 and another refrigerating compartment door 2020 is provided to open and close the remainder of the refrigerating compartment 2010.

The refrigerator also includes a freezing compartment 2030 positioned at a lower portion of the refrigerator body. The freezing compartment 2030 is opened and closed by a freezing compartment door 2040. Because the machine room 1910 is positioned at an upper portion of the refrigerator body, the refrigerator includes one or more ducts that guide air between the machine room (e.g., an evaporator in the machine room) and the freezing compartment 2030.

In some examples, an additional evaporator may be positioned in the freezing compartment 2030 (or a wall of the freezing compartment 2030). In these examples, because the machine room 1910 is positioned at an upper portion of the refrigerator body, coolant lines run between the additional evaporator and the machine room 1910.

Figure 21:
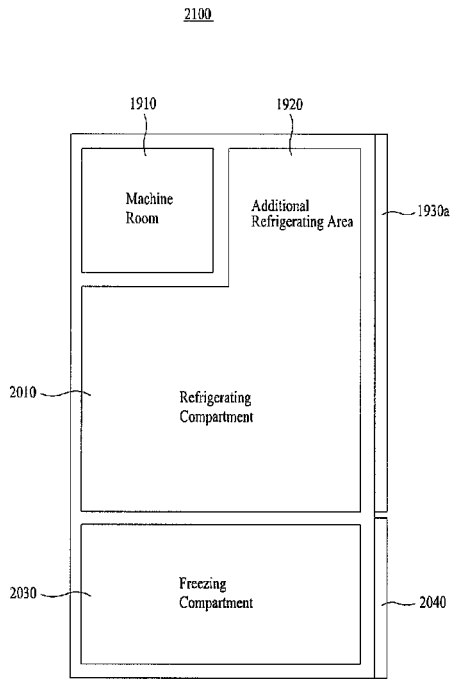
FIG. 21 is a side view illustrating another example cross-section of the example refrigerator shown in FIG. 19 taken along line 1940.

FIG. 21 illustrates another example cross-section of the example refrigerator shown in FIG. 19 taken along line 1940. In this example, the door 1930*a* opens and closes the additional refrigerating area 1920 and a remainder of the refrigerating compartment 2010.

In some implementations, the machine compartment is positioned in the upper portion of the cabinet. As a result, enlarged space may be secured in comparison with inner space of the conventional freezing or refrigerating compartment and thus storage space for storing objects may be enlarged.

Furthermore, some part of the cold air generating compartment may be provided in the upper portion of the cabinet. As a result, the forward-and-rearward width of the refrigerator may be reduced and this may result in a slim look of the refrigerator. In addition, the indoor area occupied by the refrigerator may be reduced and the utilization of the indoor space may be efficient.

In some examples, if the temperature inside at least one of the plural storage compartments changes abnormally, the cold air may be supplied to the storage compartment having the abnormal temperature change quickly and intensively. As a result, the freezing or refrigerating operation of the refrigerator may be performed not only efficiently, but also quickly.

In some implementations, the cold air may be supplied to a plurality of storage compartments by using a single evaporator. If desirable, the supply of the cold air may be performed for a specific one of the storage compartments intensively. As a result, more efficient cold air operation is possible.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. A refrigerator comprising:

a cabinet;

a storage compartment defined by the cabinet and having a top surface that defines a top of the storage compartment, the storage compartment comprising a freezing compartment and a refrigerating compartment separated by a partition wall and arranged side-by-side in parallel;

a cold air generating compartment that is positioned at an upper portion of the cabinet and that is in communication with the storage compartment, the upper portion of the cabinet being located at a vertical position that is higher than the top surface of the storage compartment;

a machine room positioned at the upper portion of the cabinet and adjacent the cold air generating compartment, the machine room comprising:

a first machine compartment provided on one side of the cold air generating compartment, wherein a condenser is installed in the first machine compartment; and a second machine compartment provided on the other side of the cold air generating compartment, wherein a compressor is installed in the second machine compartment;

an evaporator provided in the cold air generating compartment and configured to generate cold air supplied to the storage compartment;

a first cold air outlet positioned between the cold air generating compartment and the freezing compartment and configured to guide cold air generated by the evaporator toward the freezing compartment;

a second cold air outlet positioned between the cold air generating compartment and the refrigerating compartment and configured to guide cold air generated by the evaporator toward the refrigerating compartment;

a first closable damper positioned in the first cold air outlet and configured to control supply of cold air generated by the evaporator through the first cold air outlet to the freezing compartment;

a second closable damper positioned in the second cold air outlet and configured to control cold air generated by the evaporator through the second cold air outlet to the refrigerating compartment;

a first cold air fan located in the first cold air outlet and configured to move cold air generated by the evaporator through the first cold air outlet and into the freezing compartment;

a second cold air fan located in the second cold air outlet and configured to move cold air generated by the evaporator through the second cold air outlet and into the refrigerating compartment;

a first return duct that connects the freezing compartment with the cold air generating compartment and that is configured to guide air from inside of the freezing compartment toward the cold air generating compartment;

a second return duct that connects the refrigerating compartment with the cold air generating compartment and that is configured to guide air from inside of the refrigerating compartment toward the cold air generating compartment;

a first cold air inlet provided in a left side wall of the cold air generating compartment and connected with the first return duct to draw cold air having passed through the freezing compartment;

a second cold air inlet provided in the right side wall of the cold air generating compartment and connected with the second return duct to draw cold air having passed through the refrigerating compartment;

a first return damper positioned in the first cold air inlet and configured to control air flow through the first return duct; and a second return damper positioned in the second cold air inlet and configured to control air flow through the second return duct, wherein the first return duct is arranged along a left side wall and a top wall of the freezing compartment and the left side wall of the cold air generating compartment, the left side wall of the freezing compartment defining a left side of the freezing compartment and extending from a rear wall of the freezing compartment to a front of the freezing compartment, and wherein the second return duct is arranged along a right side wall and a top wall of the refrigerating compartment and the right side wall of the cold air generating compartment, the right side wall of the refrigerating compartment defining a right side of the refrigerating compartment and extending from a rear wall of the refrigerating compartment to a front of the refrigerating compartment.

2. The refrigerator of claim 1, further comprising a control unit configured to perform operations, the operations comprising:

accessing a first temperature measurement for the refrigerating compartment;

accessing a second temperature measurement for the freezing compartment;

comparing the first temperature measurement to a first temperature threshold;

comparing the second temperature measurement to a second temperature threshold;

determining whether the first temperature measurement is above the first temperature threshold and whether the second temperature measurement is above the second temperature threshold based on the comparisons; and controlling the first closable damper and the second closable damper to supply cold air generated by the evaporator to the refrigerating compartment only, the freezing compartment only, or both the refrigerating compartment and the freezing compartment based on the determination of whether the first temperature measurement is above the first temperature threshold and whether the second temperature measurement is above the second temperature threshold.

3. The refrigerator of claim 1, further comprising:

fan driving members located at the first and second cold air fans; and damper driving members located at the first and second closable dampers and the first and second return dampers, respectively.

4. The refrigerator of claim 1, wherein the first and second return ducts are configured to guide air of the storage compartment into the cold air generating compartment to pass through the evaporator from top to bottom.

5. The refrigerator of claim 1, further comprising:

a water collecting tray provided under the evaporator and inside the cold air generating compartment, the water collecting tray being configured to collect defrost water generated by the evaporator and having a cold air guiding recess provided in the water collecting tray to guide the cold air of the evaporator toward the first and second cold air outlets.

6. The refrigerator of claim 5:

wherein the first and second cold air fans are positioned directly under the cold air guiding recess and installed in centers of the first and second cold air outlets, respectively.

7. The refrigerator of claim 5, wherein:

the first closable damper is rotatably mounted between the water collecting tray and the first cold air fan, and the second closable damper is rotatably mounted between the water collecting tray and the second cold air fan.

8. The refrigerator of claim 1, further comprising:

a first housing defining the first machine compartment;

a second housing defining the second machine compartment;

a first cover member located on a front of the first housing and having a first plurality of communication holes; and a second cover member located on a front of the second housing and having a second plurality of communication holes.

9. The refrigerator of claim 1, wherein the first and second cold air fans are cross-flow fans.

10. The refrigerator of claim 9, wherein the first and second cold air fans are configured to rotate toward each side of the partition wall to cause cold air to move vertically downward along the partition wall.

11. The refrigerator of claim 10, wherein the first cold air fan rotates in a clockwise direction and the second cold air fan rotates in a counter-clockwise direction.

12. The refrigerator of claim 1, wherein:

the cold air generating compartment is an airtight space surrounded by insulation walls, and the first and second cold air inlets and the first and second cold air outlets pass through the insulation walls and are configured to enable communication between the cold air generating compartment and the freezing and refrigerating compartments.

13. The refrigerator of claim 1, wherein the cold air generating compartment is located over both of the freezing compartment and the refrigerating compartment and configured to supply cold air from the cold air generating compartment to both the freezing and refrigerating compartments uniformly.

* * * * *